US005078529A

United States Patent [19]

Moulton

[11] Patent Number: 5,078,529

[45] Date of Patent: Jan. 7, 1992

[54] SEISMIC EXPANSION JOINT COVER

[75] Inventor: Paul Moulton, Williamsport, Pa.

[73] Assignee: Construction Specialties, Inc., Cranford, N.J.

[21] Appl. No.: 657,518

[22] Filed: Feb. 19, 1991

[51] Int. Cl.[5] ..... F16D 1/00

[52] U.S. Cl. ..... 403/24; 403/405.1; 52/167 R; 52/573

[58] Field of Search ..... 52/167 R, 573; 403/405.1, 24

[56] References Cited

U.S. PATENT DOCUMENTS

| | | | |
|---|---|---|---|
| 3,648,423 | 3/1972 | Cole | 52/573 X |
| 3,745,726 | 7/1973 | Thom | 52/573 X |
| 4,833,851 | 5/1989 | Ohmatsu | 52/573 X |

*Primary Examiner*—Andrew V. Kundrat
*Attorney, Agent, or Firm*—Brumbaugh, Graves, Donohue & Raymond

[57] ABSTRACT

A seismic expansion joint cover comprises a pair of elongated frame members, each of which is adapted to be secured to a building member, one on one side of an expansion gap and the other on the other side of the expansion gap, and each of which has a planar support surface and an edge adapted to overhang the gap. An elongated cover member spans the expansion gap and is supported on the support surfaces of the respective frame members for sliding movement of the frame members relative to the cover member. A hold-down assembly resiliently holds the cover member in engagement with the support surfaces of the frame members. A multiplicity of deflector members on the cover member, each having an inclined surface that is engageable by the overhanging edge of one of the frame members upon narrowing of the expansion gap during a seismic event, is adapted upon such engagement to displace the cover member against the bias of the hold-down assembly to a position in which its side edges are not susceptible to contact with any portions of the frame members or the building members upon further narrowing of the expansion gap. Gaskets are detachably connected to the side edge of the cover member and to the frame members.

9 Claims, 3 Drawing Sheets

SEISMIC EXPANSION JOINT COVER

BACKGROUND OF THE INVENTION

Many architects prefer to use flush expansion joint covers wherever possible for good appearance and a minimum of discontinuity in the exposed surface of the joint. A preferred type of flush expansion joint cover is one that employs a compressible, extendable gasket between one or both edges of the cover member and the corresponding frame member. The gaskets maintain substantial continuity of the elements of the cover upon expansions and contractions of the joint and also provide an air and liquid seal for isolating the building interior from the expansion space. In such expansion joint covers, the surface of the cover member lies flush with the plane of the surfaces of the building members on either side of the joint.

The maximum excursion toward and away from each other of the building members at the expansion gap for a cover with one gasket is about two inches (one inch compression and one inch extension), which is rarely exceeded in conventional building designs. Expansion joint covers with gaskets between both edges of the cover member and the respective frame members can be used for excursions of up to four inches. In buildings designed to withstand earthquakes (seismic events), however, the expansion joints are virtually always designed to endure excursions of the building members at the joint of more than four inches and may be designed for excursions of up to 20 inches. Although conventional flush expansion joint covers of the type with gaskets and flush cover members can be used in seismic expansion joints and will serve entirely satisfactorily under normal excursions of the building members at the joint due to thermal expansions and contractions of the structure and movements due to wind loads, a significant seismic event will almost certainly severely damage the expansion joints, due to dislodgement coupled with rupture of the gaskets and to buckling of the cover members caused by forced contacts with the frames of the joint covers upon closures of the expansion gap.

SUMMARY OF THE INVENTION

An object of the present invention is to provide a seismic expansion joint cover of the type having a cover member that is flush with the surfaces of the building members that will endure seismic events without damage. A further object is to provide a seismic expansion joint cover that is attractive in appearance and provides maximum continuity between the components by virtue of incorporating flush gaskets between the cover member and the frame members. Another object is to provide a seismic expansion joint cover that incorporates gaskets forming air and liquid seals for isolating the space within the building from the expansion space of an expansion joint, the gaskets being installed in a manner that enables them to dislodge from the frames when the cover is subjected to a significant seismic event.

The foregoing and other objects are attained, according to the present invention, by a seismic expansion joint cover comprising a pair of elongated frame members, each of which is adapted to be secured to a building member, one on one side of an expansion gap and the other on the other side of the expansion gap, and each of which has a planar support surface and an edge adapted to overhang the gap. An elongated cover member adapted to span the expansion gap is supported on the support surfaces of the respective frame members for sliding movement of the frame members relative to the cover member. Hold-down assemblies resiliently hold the cover member in engagement with the support surfaces of the frame members. A multiplicity of deflector members on the cover member, each having an inclined surface that is engageable by the edge of one of the frame members upon narrowing of the expansion gap during a seismic event, cause the cover member to displace against the bias of the hold-down assemblies to a position in which its side edges are not susceptible to contact with any portions of the frame members or the building members upon further narrowing of the expansion gap.

In a preferred embodiment, the surfaces of the building members adjacent the expansion joint cover define a plane, and the support surfaces of the frame members are recessed below the plane of the building members. The cover member has a planar surface substantially coplanar with the plane of the building members. The frame members have edge flange portions at the edges remote from the expansion gap, and the side edges of the cover member are spaced apart from the edge flanges of the frame members under normal movements of the building members. An elongated expandable and contractible gasket is releasably joined to each side edge of the cover member and to the edge flange portion of the corresponding frame member such that each gasket can detach from either the side edge of the cover or the edge flange portion of the frame member upon displacement of the cover member in a seismic event.

A preferred hold-down assembly includes a multiplicity of pivot bars spaced-apart longitudinally of the frame members, extending across the expansion gap obliquely to a longitudinal axis of the expansion gap, engaging the frame members against upward movement and having their opposite ends slidably coupled to the respective frame members, and spring mechanisms coupling the cover member to each pivot bar and urging them resiliently toward each other. Suitably, the spring mechanism includes a bolt passing through holes in the cover member and in the pivot bar and a compression spring engaged under compression between an abutment on a portion of the bolt on the side of the pivot bar opposite from the cover member and the pivot bar. In an advantageous arrangement, the portion of the bolt having the abutment for the spring is threaded, and the abutment is a nut threaded onto said threaded portion with a washer interposed between the nut and the spring and the washer and nut welded to the spring. This arrangement enables the compression force of the spring to be adjusted from within the building space by turning the bolt, such as by using an inch/pound torque wrench.

An economical and effective form of deflector member is a metal band having a generally V-shaped body portion, one leg of which constitutes the inclined surface, and arm portions joined to the body portion and to the cover member. Such deflector members may be pieces cut to a desired length from an elongated extruded member having a cross-section such as to define the body portion and the arm portions of the deflector members.

For a better understanding of the invention, reference may be made to the following description of an exemplary embodiment, taken in conjunction with the figures of the accompanying drawings.

DESCRIPTION OF THE DRAWINGS

FIG. 2 —maximum normal contraction ("normal" meaning due to thermal effects and load conditions not caused by seismic events);

FIG. 3 —a moderate contraction due to a seismic event;

FIG. 4 —maximum contraction due to a major seismic event;

FIG. 5 —maximum normal expansion; and

FIG. 6 —maximum expansion due to a major seismic event.

DESCRIPTION OF THE EMBODIMENT

Figure 1:
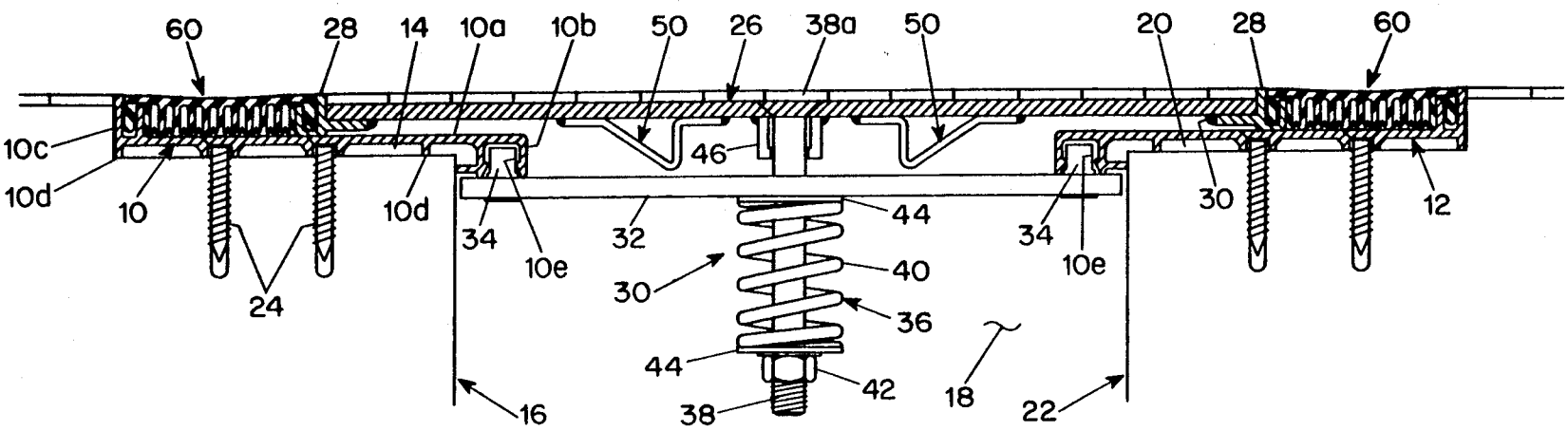
FIG. 1 is a transverse cross-sectional view of the embodiment showing it installed in an expansion joint and showing the joint at the neutral point midway between maximum expansion and maximum contraction.

The embodiment of a seismic expansion joint cover, according to the present invention, shown in the drawings comprises a pair of frame members 10 and 12, one 10 of which is installed in a recess 14 in a building member 16 on one side of an expansion gap 18 and the other 12 of which is installed in a recess 20 in another building member 22 on the other side of the expansion gap 18. The frame members 10 and 12 are essentially longitudinally continuous along the length of the gap 18 (subject to length restrictions in production and shipping) and are aluminum extrusions of uniform cross-section along their lengths. The same frame members are used on both sides of the joint, one being reversed end to end with respect to the other. With reference to the frame member 10, each frame member has a planar support portion 10*a*, an edge portion 10*b* that overhangs the gap 18, and an edge flange portion 10*c* at the edge of the support portion remote from the gap. Ribs 10*d* on its underside provide a standoff of the support portion from the bottoms of the recesses in the building members to facilitate accommodation of the frame members to surface irregularities. The frame members are secured to the building members by masonry anchors 24.

An elongated cover member 26, which is a plate of metal such as aluminum, stainless steel, brass or the like, extends lengthwise of the joint and spans it crosswise. A cover edge member 28 is fastened, such as by weldments 28*a*, to each edge of the cover member and supports the cover member in sliding relation on the support portion of the respective frame member. Various edge members 28 having different dimensions can be provided to permit the upper surface of the cover member to be located at different positions with respect to an adjacent floor and floor tile (as shown), carpet or other floor coverings to be applied to the cover member flush with the floor coverings within the space where the expansion joint seal is located.

The cover member is normally retained in engagement with the support portions of the frame members by a multiplicity of hold-down assemblies 30 spaced apart at suitable intervals along the length of the expansion joint. Each hold-down assembly includes a pivot bar 32 that extends across the expansion gap obliquely to the longitudinal axis of the expansion gap, engages the frame members against upward movement and has its opposite ends slidably coupled to the respective frame members by means of stainless steel pivot pins 34, each of which is received in a channel portion 10*e* of the frame member that opens downwardly from the overhanging edge portion 10*b*. A spring mechanism 36 couples the cover member to each pivot bar and urges the cover member resiliently into engagement with the frame members toward each other. Each spring mechanism includes a bolt 38 that passes through a hole in the cover member and a hole in the pivot bar 32 and a compression spring 40 engaged under compression between the pivot bar and an abutment 42 on a portion of the bolt on the side of the pivot bar opposite from the cover member. The portion of the bolt adjacent the pivot bar is threaded, and the abutment is a nut threaded onto the threaded portion and the abutment 42 consists of a nut 43 and a washer 44 interposed between the nut 43 and the spring 40, the washer and nut being welded to the spring. This arrangement enables the compression force of the spring 40 to be adjusted from within the building space by turning the bolt 38, such as by using an inch/pound torque wrench. Another washer 44 is interposed between the upper end of the spring and the pivot bar. The head portion 38*a* of each bolt 38 is countersunk into the hole in the cover member. The margins of the holes in the cover member for the bolts are reinforced by collars 46 welded to the underside of the cover member around each hole.

Figure 6:
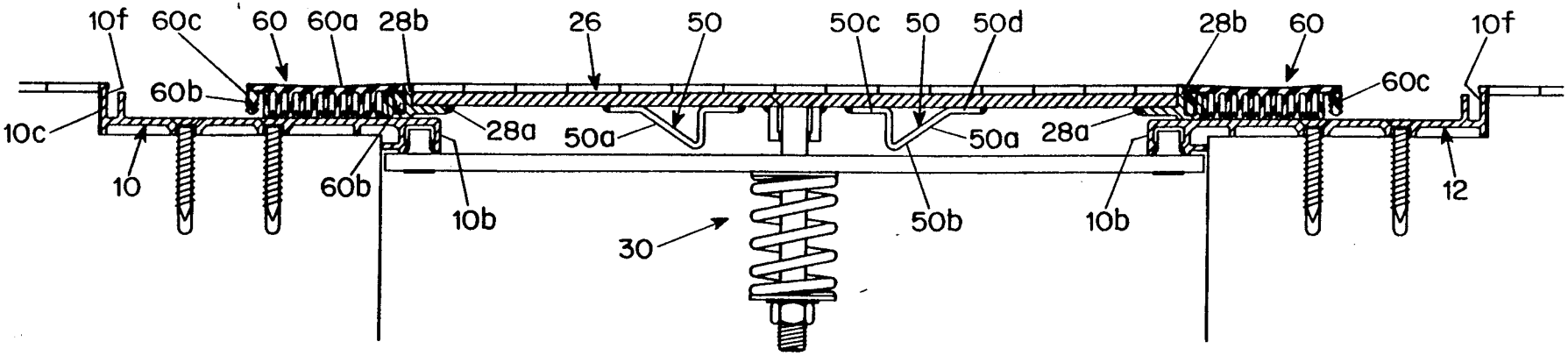

A multiplicity of deflector members 50 are located on the underside of the cover member 26. Each deflector member has an inclined surface 50*a* (refer to FIG. 6) that is engageable by the edge 10*b* of one of the frame members 10 upon narrowing of the expansion gap during a seismic event and is adapted upon such engagement to displace the cover member against the bias of the hold-down assembly 30 to a position in which its side edges are not susceptible to contact with any portions of the frame members or the building members upon further narrowing of the expansion gap. Each deflector member 50 is a metal band having a generally V-shaped body portion 50*b*, one leg of which constitutes the inclined surface 50*a*, and arm portions 50*c*, 50*d* joined to the body portion 50*b* and to the cover member 10. The deflector members 50 are pieces cut to a desired length, 2 inches being suitable, from an elongated aluminum extrusion having a cross-section such as to define the body portions and the arm portions of the deflector members 50. The deflector members are arranged in opposite-facing pairs at a suitable longitudinal spacing along the cover member.

An elongated expandable and compressible gasket 60 is releasably joined to each side edge of the cover member 26 and to the edge flange portion 10*c* of the corresponding frame member 10 such that each gasket detaches from the edge flange portion of the frame member upon displacement of the cover member in a seismic event. The gasket 60 is of the type that is described and shown in U.S. Pat. application Ser. No. 07/634,013, filed Dec. 26, 1990, and now Pat. No. 5,048,249 and entitled "Gasket for Flush Expansion Joint Cover" to which reference may be made for a full description and which is hereby incorporated into the present specification by this reference to it. Briefly, each gasket 60 is coextruded from thermoplastic rubber compounds of different hardnesses. The major part 60*a* of the gasket (see FIG. 6), which consists of walls defining numerous oval-shaped cells, is of a softer compound that enables it to deform readily. Portions 60*b* along each edge of a generally "U" shape are formed of a harder compound, which enables them to be attached relatively securely by reception of a dependant side leg 60*c* of the harder compound in a groove. One side leg 60*c* is of each gasket 60 is received in a groove 28*b* defined by legs of the adaptor member 28 on the cover member 26, and the other side leg of each gasket is received in a groove 10*f* defined by the edge flange portion of each frame member 10.

In the condition shown in FIG. 1, the expansion joint cover is at a neutral point midway between the maximum expansion and maximum contraction of the expansion gap. The gaskets are essentially totally relaxed, and the cover member 26 is held down in engagement with the support portions 10*a*of the frame members 10 by the hold-down assemblies 30.

Upon normal narrowing of the expansion gap due to thermal expansion of the structures on opposite sides of the expansion gap or wind loads (see FIG. 2), the gaskets 60 are compressed, the oval-shaped cells in the softer body portion 60*a* being collapsed. The hold-down assemblies 30 continue to hold the cover member 26 in engagement with the bearing surfaces of the frame members 10 against the tendency for the compressed gaskets to push it upwardly and unseat it from the bearing surfaces. Upon movement of the frame members toward each other, the overhanging edge portions 10*b* approach but do not engage the inclined surfaces 50*a* of the deflector members 50. Upon narrowing of the expansion gap, the channels 10*e* of the frame members push against the pins 34 of the pivot bars 32 and cause the pivot bars to rotate about the bolts 38 so that they become skewed at a greater angles to the longitudinal axis of the expansion gap, the pins concurrently sliding lengthwise along the channel-shaped portions 10*e*.

Figure 2:
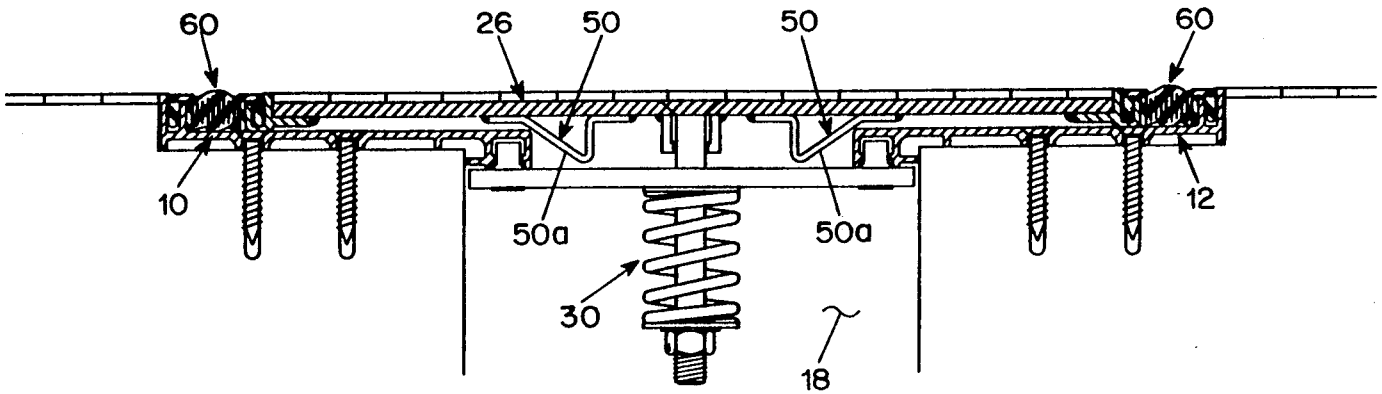
FIGS. 2 to 6 are also transverse cross-sectional views of the embodiment, show it installed in an expansion joint, and show the expansion joint in the following states.
Figure 3:
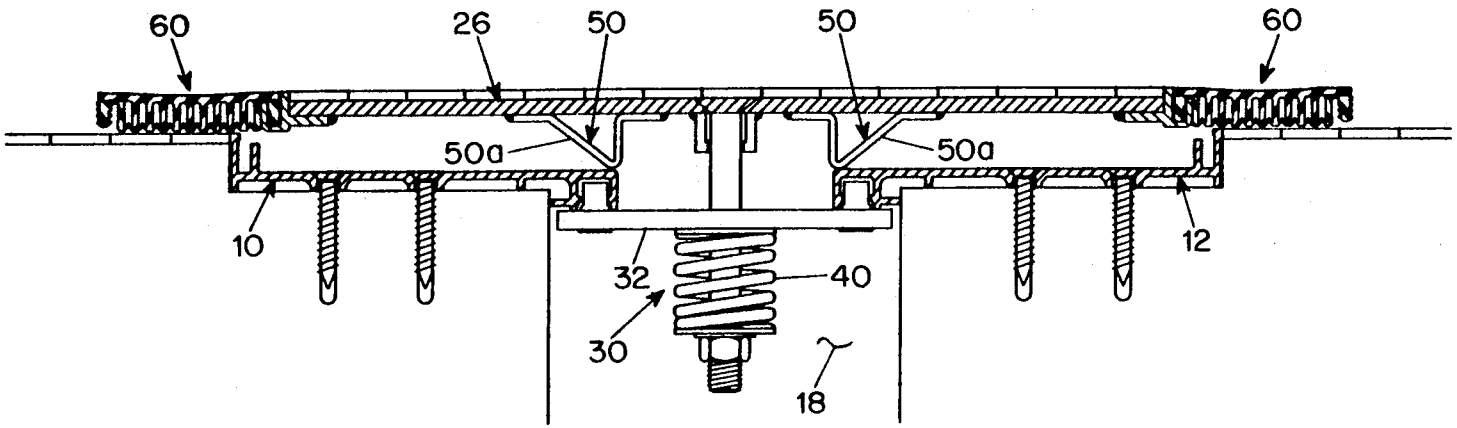

Upon an abnormally large narrowing of the expansion gap, such as one caused by a seismic event, the condition shown in FIG. 3 is attained. Upon closing of the gap a little more than is shown in FIG. 2, the overhanging edges 10*b* of the frame members 30 engage the inclined surfaces 50*a* of the deflector members 50. By a camming action of the edges against the inclined surfaces, the cover member 26 is pushed upwardly against the opposing forces of the hold-down assemblies, the springs 40 yielding to permit that upward movement. Simultaneously with the upward movement of the cover member, the portions of the gaskets 60 that are attached to the cover member are lifted up. Because the gaskets are virtually fully compressed, they behave as substantially rigid members, and the outer edge legs 60*c* are dislodged from the retaining grooves 10*f* in the frame members, whereupon the gaskets resile to a relaxed state. Dislodgement of the gaskets from attachment to the frame members ensures that they will not by damaged by the extreme narrowing of the expansion gap in a seismic event. Moreover, should the closure of the gap continue from the condition shown in FIG. 3 to that shown in FIG. 4, the deflection members continue to hold the cover member in a raised condition by riding along the support portions surfaces 10*a*. In the raised condition, the cover member 26 is held up high enough so that its side edges are not contacted by the edge flange portions 10*c* of the frame members, and buckling of or other damage to the cover member or to the frame members is prevented.

Figure 4:
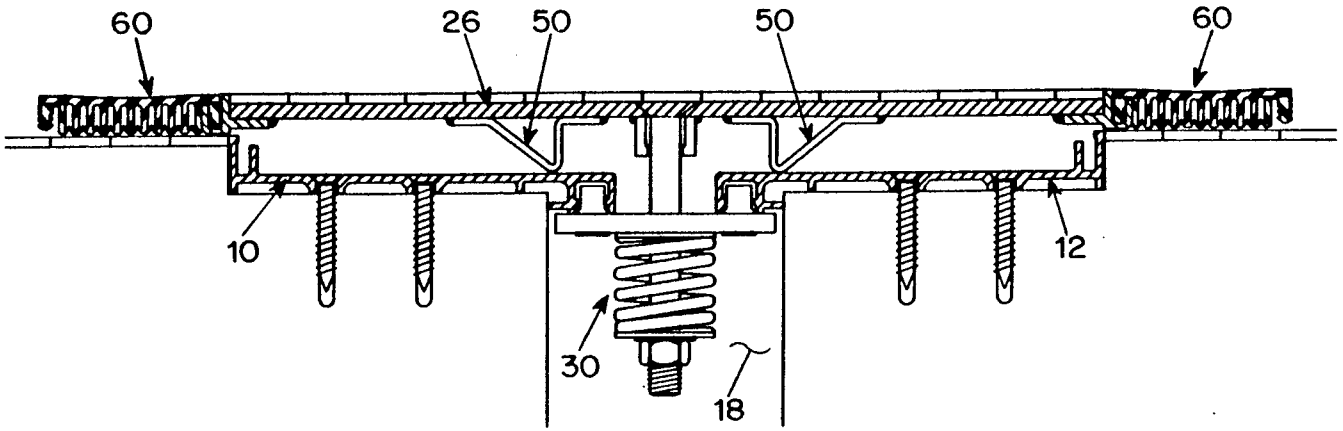

When the expansion gap enlarges after closing to the extent shown in FIG. 3 or 4, the process shown in the drawings and described above reverses. The springs of the hold-down assemblies restore the cover member into engagement with the support portions of the frame members, as permitted by movements of the frame members out from under the deflector members. The gaskets, of course, remain dislodged from the assembly (see FIG. 6). Upon cyclical opening and closing of the expansion gap in a seismic event, the cover member and gaskets move between the positions shown in FIG. 4 and FIG. 6. At a suitable time after the occurrence of a seismic event, when the expansion joint cover is at some condition of normal extension or contraction, the expansion joint cover can be restored to a fully operative condition by reinserting the outer edge legs of the gaskets into the grooves 10*f* of the frame members.

Figure 5:
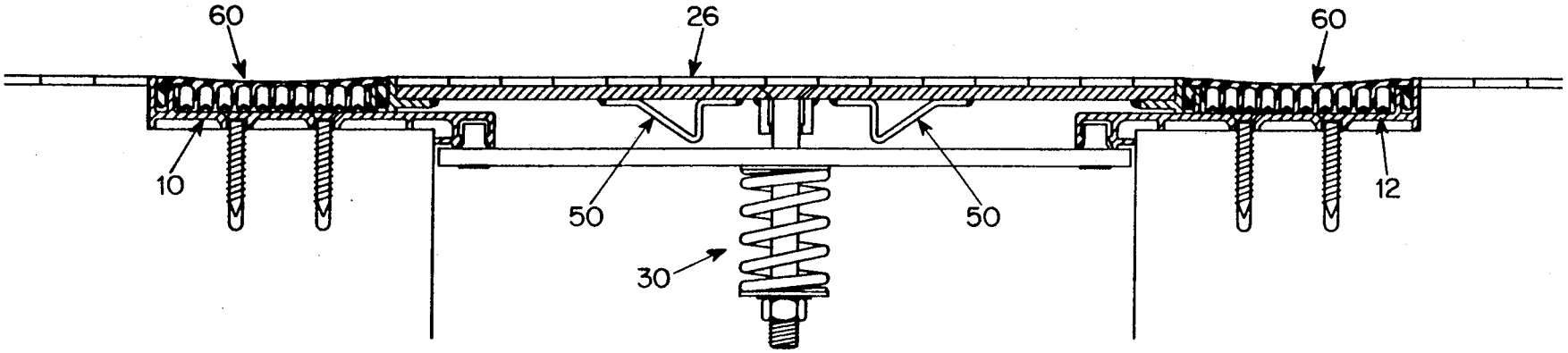

FIG. 5 shows the expansion joint cover in the position it attains at the maximum normal enhancement of the expansion gap. The gaskets 60 become stretched by elastic yielding of the softer portions 60*a*, which results in lateral distention of the cells as the top and bottom wall portions elongate. Under normal expansion and contraction of the gaskets, the top surfaces remain generally flush with the floor surfaces on either side of the expansion joint.

If the initial abnormally large movement of the structures on either side of the joint in a seismic event is such as to cause the expansion gap to widen, the tension in the gaskets will be sufficient at some point to pull the outer leg portions out of the retaining grooves in either the cover member or the frame members. Widening of the expansion gap presents no chance of damage to the cover member, and the detachment of the gaskets minimizes the possibility that they will be damaged.

The expansion joint cover of the present invention is especially well-suited for use in floor joints but can also be used to advantage in wall and ceiling joints.

I claim:

1. A seismic expansion joint cover comprising a pair of elongated frame members, each of which is adapted to be secured to a building member, one on one side of an expansion gap and the other on the other side of the expansion gap, and each of which has a planar support surface and an edge adapted to overhang the gap, an elongated cover member adapted to span the expansion gap and supported on the support surfaces of the respective frame members for sliding movement of the frame members relative to the cover member, hold-down means for resiliently holding the cover member in engagement with the support surfaces of the frame members, and a multiplicity of deflector members on the cover member, each having an inclined surface that is engageable by the overhanging edge of one of the frame members upon narrowing of the expansion gap during a seismic event and is adapted upon such engagement to displace the cover member against the bias of the hold-down means to a position in which its side edges are not susceptible to contact with any portions of the frame members or the building members upon further narrowing of the expansion gap.

2. A seismic expansion joint cover according to claim 1 wherein surfaces of the building members adjacent the expansion joint cover define a plane, the support surfaces of the frame members are recessed below the plane of the building members, the cover has a planar surface substantially coplanar with the plane of the building members, the frame members have edge flange portions at the edges remote from the expansion gap, and the side edges of the cover member are spaced apart from the edge flanges of the frame members under normal movements of the building members, and further comprising an elongated expandable and contractible gasket detachably joined to each side edge of the cover member and to the edge flange portion of the corresponding frame member such that each gasket can detach from either side edge of the cover or the edge flange portion of the frame member upon displacement of the cover member in a seismic event.

3. A seismic expansion joint cover according to claim 1 wherein the hold-down means includes a multiplicity of pivot bars spaced-apart longitudinally of the frame members, extending across the expansion gap obliquely to a longitudinal axis of the expansion gap, engaging the frame members against upward movement and having their opposite ends slidably coupled to the respective frame members, and spring means coupling the cover member to each pivot bar and urging them resiliently toward each other.

4. A seismic expansion joint cover according to claim 3 wherein the spring means includes a bolt passing through holes in the cover member in the pivot bar and a compression spring engaged under compression between the pivot bar and an abutment on a portion of the bolt on the side of the pivot bar opposite from the cover member.

5. A seismic expansion joint cover according to claim 4 wherein said portion of the bolt is threaded and the abutment is a nut threaded onto said threaded portion, whereby the compression in the spring may be adjusted by means of relative rotation of the bolt and the nut.

6. A seismic expansion joint cover according to claim 5 wherein a washer is interposed between the nut and the spring and the washer and nut are welded to the spring, whereby the compression force of the spring can be adjusted from within the building space by turning the bolt.

7. A seismic expansion joint cover according to claim 4 wherein surfaces of the building members adjacent the expansion joint cover define a plane, the support surfaces of the frame members are recessed below the plane of the building members, the cover has a planar surface substantially coplanar with the plane of the building members, the frame members have edge flange portions at the edges remote from the expansion gap, and the side edges of the cover member are spaced apart from the edge flanges of the frame members under normal movements of the building members, and further comprising an elongated expandable and contractible gasket detachably joined to each side edge of the cover member and to the edge flange portion of the corresponding frame member such that each gasket can detach from either the side edge of the cover member or the edge flange portion of the frame member upon displacement of the cover member in a seismic event.

8. A seismic expansion joint cover according to claim 1 wherein each deflector member is a metal band having a generally V-shaped body portion, one leg of which constitutes the inclined surface, and arm portions joined to the body portion and to the cover member.

9. A seismic expansion joint cover according to claim 8 wherein the deflector members are pieces cut to a desired length from an elongated extruded member having a cross-section such as to define the body portion and the arm portions of the deflector members.

* * * * *